US008720128B2

(12) United States Patent
Vogt

(10) Patent No.: US 8,720,128 B2
(45) Date of Patent: May 13, 2014

(54) MAST ASSEMBLY WITH CYLINDER NESTED IN SUBSTRUCTURE

(71) Applicant: Woolslayer Companies, Inc., Tulsa, OK (US)

(72) Inventor: Dewayne G. Vogt, Tulsa, OK (US)

(73) Assignee: Woolslayer Companies, Inc., Tulsa, OK (US)

( * ) Notice: Subject to any disclaimer, the term of this patent is extended or adjusted under 35 U.S.C. 154(b) by 27 days.

(21) Appl. No.: 13/632,602

(22) Filed: Oct. 1, 2012

(65) Prior Publication Data

US 2014/0090333 A1 Apr. 3, 2014

(51) Int. Cl.

| | |
|---|---|
| ***B66C 23/06*** | (2006.01) |
| ***B66C 23/62*** | (2006.01) |
| ***E04H 12/34*** | (2006.01) |

(52) U.S. Cl.

USPC ..... 52/116; 52/117; 52/118; 52/123.1; 52/127.2; 175/202; 173/28

(58) Field of Classification Search

USPC ..... 52/127.1, 127.2, 745.18, 651.05, 127.5, 52/745.17, 125.6, 125.2, 117, 112, 116, 52/119, 118, 120, 129.1, 645, 123.1; 175/202, 203; 16/235; 414/10; 173/28, 173/39

See application file for complete search history.

(56) References Cited

U.S. PATENT DOCUMENTS

| | | | | |
|---|---|---|---|---|
| 2,711,804 | A * | 6/1955 | Woolslayer et al. | 52/292 |
| 3,483,933 | A * | 12/1969 | Dyer et al. | 173/39 |
| 3,942,593 | A * | 3/1976 | Reeve et al. | 173/186 |
| 4,932,175 | A * | 6/1990 | Donnally | 52/118 |
| 6,594,960 | B2 | 7/2003 | Brittain et al. | |
| 6,821,071 | B2 | 11/2004 | Woolslayer et al. | |
| 6,910,679 | B1 * | 6/2005 | Vogt et al. | 254/385 |
| 6,994,171 | B2 * | 2/2006 | Orr et al. | 173/28 |
| 8,112,946 | B2 | 2/2012 | Vogt | |
| 8,250,826 | B1 | 8/2012 | Vogt | |
| 8,516,751 | B2 * | 8/2013 | Konduc et al. | 52/112 |
| 2011/0072737 | A1 * | 3/2011 | Wasterval | 52/115 |
| 2011/0302869 | A1 | 12/2011 | Vogt et al. | |

* cited by examiner

*Primary Examiner* — Chi Q Nguyen

(74) *Attorney, Agent, or Firm* — Head, Johnson & Kachigian, P.C.

(57) ABSTRACT

A method to disassemble a mast assembly having a substructure including a first and second section, a first and a second cylinder, and a lower mast section. The method includes the steps of disengaging a pair of front mast legs of the lower mast section from a pair of front leg supports. The pair of front leg supports are moved from an operational to a transport position. The lower mast section is lowered from a vertical to a horizontal position by retracting the first cylinder and the second cylinder. A mast center spreader is thereafter removed from the lower mast section. A center drill floor section is removed from between the first substructure section and the second substructure section so that a combination of the first substructure section, the first cylinder and a portion of the lower mast and a combination of the second substructure section, the second cylinder and a portion of the lower mast may be transported.

19 Claims, 9 Drawing Sheets

MAST ASSEMBLY WITH CYLINDER NESTED IN SUBSTRUCTURE

BACKGROUND OF THE INVENTION

1. Field of the Invention

The present invention is directed to a method and an apparatus for a mast assembly wherein the mast raising cylinders will be nested in a box-type substructure for transportation and storage. In particular, the present invention is directed to a method and apparatus for a mast assembly which improves assembly and disassembly time and facilitates transportation thereof.

2. Related Art

Drilling rigs used to explore for subterranean oil and gas are traditionally moved to a desired drilling site. The rig equipment is then assembled and the drilling or servicing operation performed. After the drilling or servicing operation has been completed, the equipment is traditionally disassembled piece by piece and moved to another drilling or servicing site and reassembled. The equipment may be transported on dollies or flatbed tractor trailers.

The time and required personnel to assemble the drilling rig and thereafter to disassemble and transport the drilling rig to another location is an important factor in the overall expense of the drilling operation.

One type of drilling rig utilizes a mast or derrick assembly having a lower mast section, a center mast section mounted on top of the lower mast section, and an upper mast section mounted on top of the center mast section. In one arrangement, each mast section includes a pair of opposed sides, a back face and an open front. The opposed sides include braces, trusses or supports. The open front facilitates entry and removal of lengths of tubulars. A crown block on top of the upper mast section facilitates reciprocal vertical movement of a moving block and tackle and other drilling equipment. A pair of hydraulic cylinders moves the lower mast section, center mast section and upper mast section from a horizontal storage and transportation position to a vertical operational position during the assembly and the disassembly procedure.

Various equipment is located on a drill or drilling floor which is often elevated from ground level so that additional equipment, such as a blowout preventer, may be installed beneath the drill floor. A substructure or substructures elevate the drill floor above ground level.

It is a principal object and purpose of the present invention to improve the assembly or rig up time and effort and improve the disassembly or rig down time and effort required.

It is a further object and purpose of the present invention to eliminate disconnection of the cylinders from the substructure during the disassembly procedure so that the cylinders are stored and transported along with the substructure.

Additionally, it would be advantageous for the equipment to be moved to meet roadway requirements for size of load. For example, certain highway regulations limit the width of the load to twelve feet. Highway regulations may also limit the height of the load.

Accordingly, it is a further object and purpose of the present invention to minimize disassembly and reassembly of the mast assembly while permitting transportation on flat bed trailers.

SUMMARY OF THE INVENTION

The present invention is directed to a method and to an apparatus to disassemble a mast assembly and to reassemble a mast assembly.

In order to disassemble the drilling rig, the following procedure is employed.

1. A pair of front leg pins is removed in order to disengage a pair of front mast legs from a pair of front mast leg supports.
2. A pair of floor sections is lowered by hinging the floor sections downward from the drill floor.
3. The pair of front leg mast supports are thereafter moved from an operational position into a transport position.
4. The mast sections are lowered by retracting the cylinders. The mast sections will thereby be moved from a vertical position to a horizontal position.
5. Once in the horizontal position, the upper mast and center mast sections will be removed.
6. A mast center spreader section will be unpinned or unfastened and then removed from the lower mast section.
7. A rectangular center drill floor section or rotary set back skid will thereafter be removed from the drill floor. Thereafter, each of the combination substructure section and cylinder with lower mast section will be lifted off of the remaining substructure section. Each combination substructure section and cylinder with lower mast section can then be transported on a dolly or a flatbed tractor-trailer.

In order to assemble the drilling rig, the reverse procedure is performed.

1. The various substructure boxes or sections are transported to a desired location such as a drilling site. The driller side substructure section and the accompanying cylinder with a portion of the lower mast section are brought into place. Likewise, the off-driller side substructure section and accompanying cylinder with a portion of the lower mast section is brought into place.
2. The center drill floor section is lowered in place between the substructures at the drill floor level.
3. The mast center spreader section is installed and connected to the lower mast section.
4. The mast center section or midsection is connected to the lower mast section and the mast top section is thereafter installed.
5. The pair of hydraulic cylinders is extended and pivots about the rear shoes in order to raise the mast assembly from a horizontal transport position to a vertical operational position.
6. Thereafter, the pair of front leg supports are moved from a transport position to an operational position.
7. The front leg pins or fasteners are installed or connected to secure the pair of front mast leg supports to the pair of front mast legs.
8. The floor sections are thereafter raised into an operational position level with the drill floor by rotating about the hinges and connected.

BRIEF DESCRIPTION OF THE DRAWINGS

FIG. 5 illustrates a side view of the mast assembly shown in FIG. 1 in a lowered, horizontal position, while

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Figure 1:
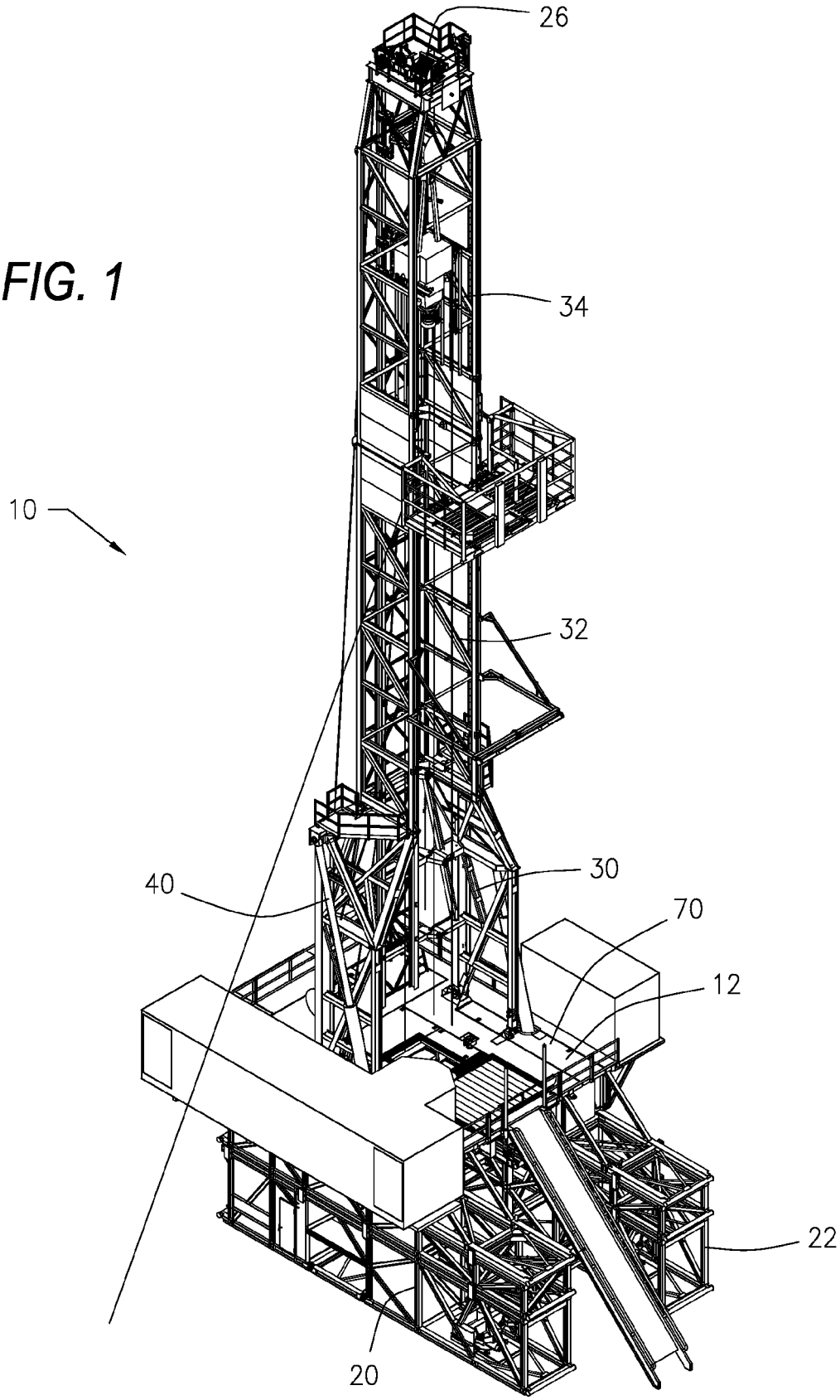
FIG. 1 illustrates a perspective view of a mast assembly constructed in accordance with the present invention in a vertical, operational position.

Referring to the drawings in detail, FIG. 1 illustrates a perspective or isometric view of a mast assembly 10 which has been assembled and is in operational position.

Figure 2:
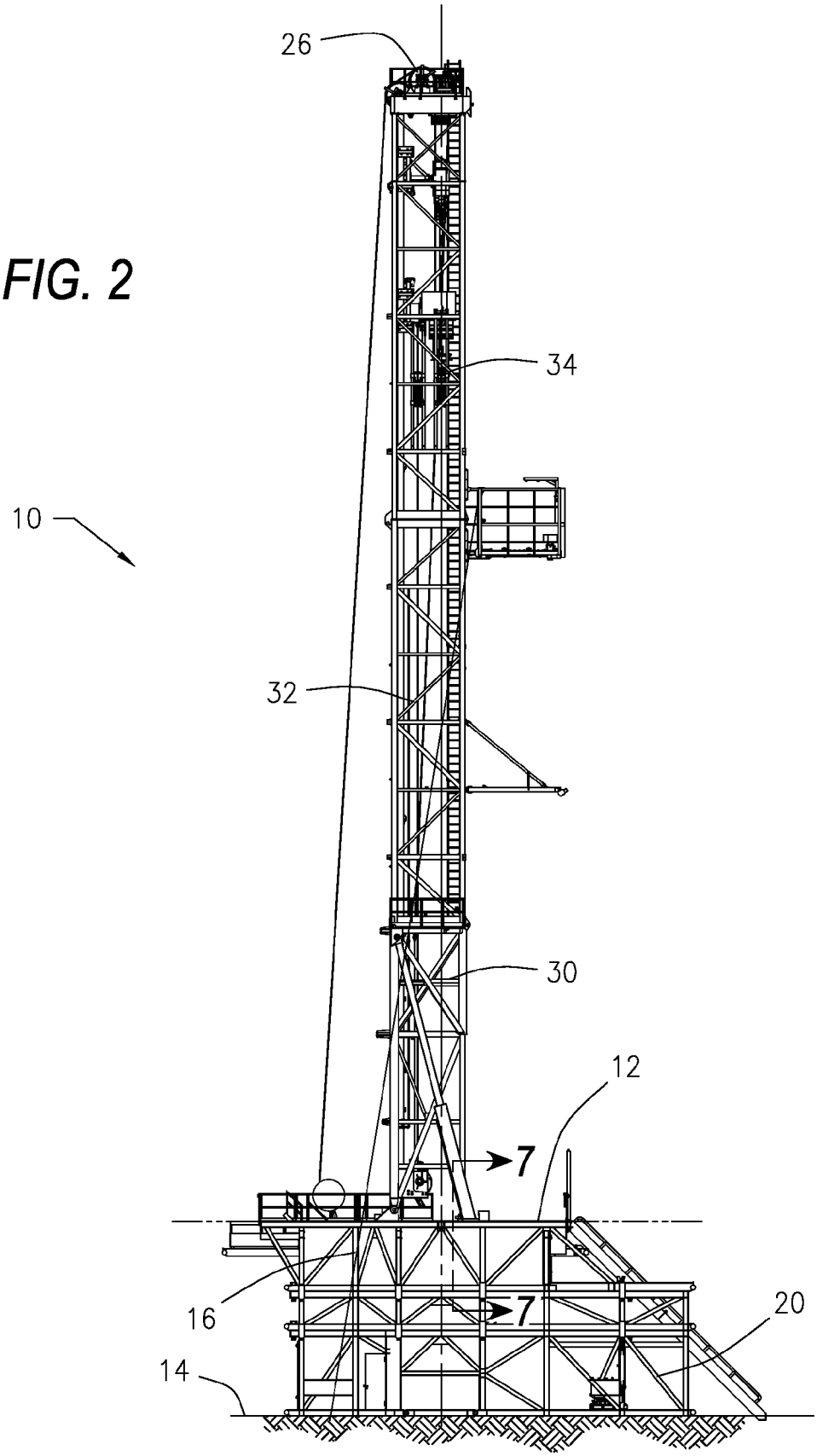
FIG. 2 illustrates a side view.
Figure 3:
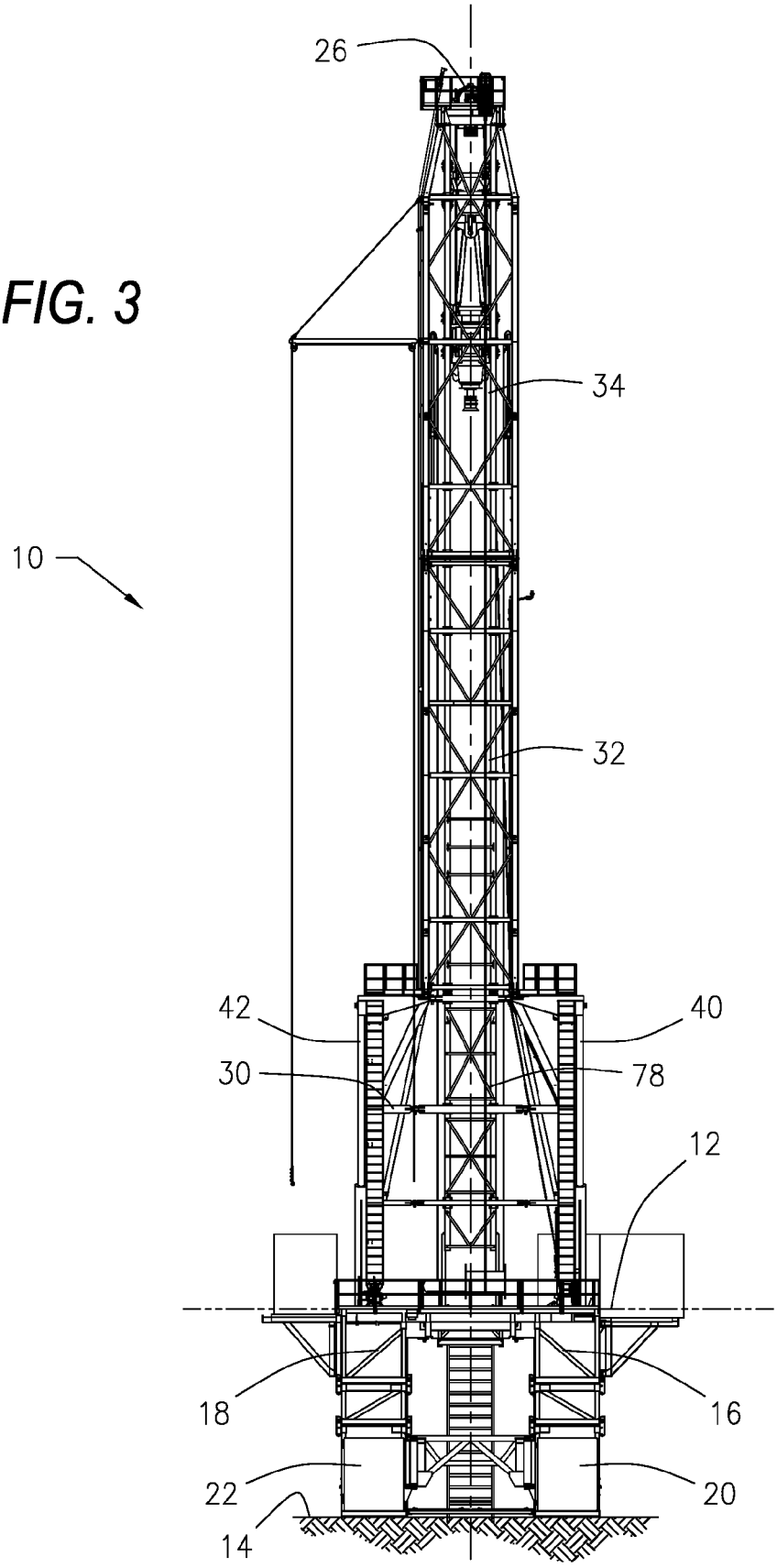
FIG. 3 illustrates an alternate side view and FIG. 4 illustrates a front view of the mast assembly shown in FIG. 1.

FIG. 2 illustrates one side view of the mast assembly shown in FIG. 1, known as the driller's side. FIG. 3 illustrates an alternate side, known as the draw works side.

Figure 4:
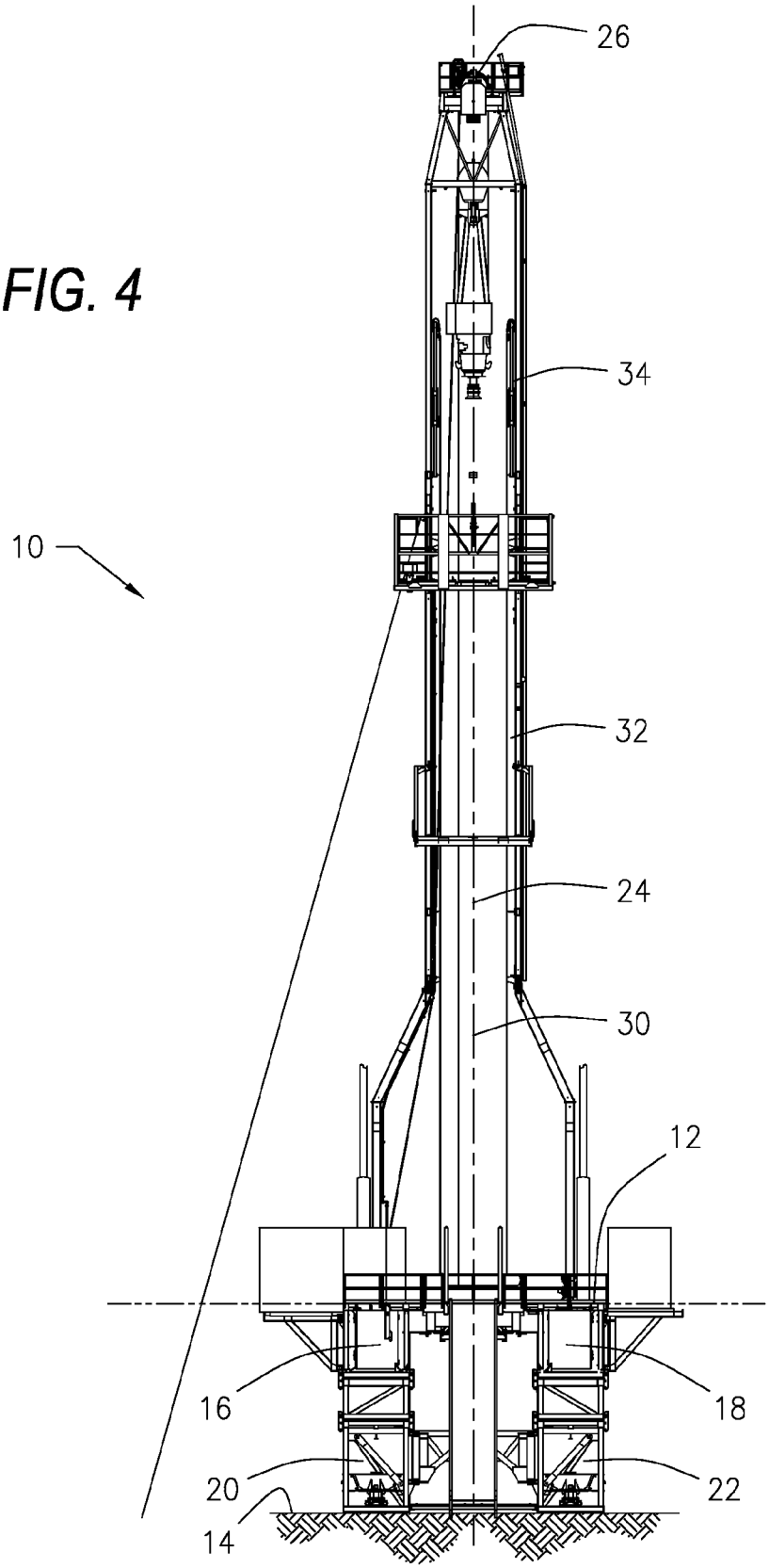

FIG. 4 illustrates a front view or V-door side view of the mast assembly 10. In one type of mast assembly, the driller's side, the draw works side and the rear or back side are substantially closed while the front side or face is substantially open as best seen in FIG. 4. The open front facilitates entry and removal of lengths of tubulars.

A drill floor 12 is often located above ground level 14 over a well center illustrated by a well center line 24 shown by a dashed line in FIGS. 2, 3 and 4. The drill floor 12 acts as a platform and staging area for various equipment on the drilling site and acts as a platform for personnel.

A substructure beneath and supporting the drill floor 12 includes a first substructure section 16 and a second substructure section 18 spaced from the first section surrounding the well center. Depending on the desired height and positioning of the drill floor, various vertical extensions 20 and 22 may also be provided beneath the substructure sections.

Depending on the height and configuration of the drilling rig, there may be provided a lower mast section 30, a center mast section or mast midsection 32 and an upper mast section 34. A greater or lesser number of mast sections may be employed within the spirit and scope of the invention. On top of the upper mast section will be located a crown block 26 to enable a wire line or wire lines to operate for reciprocal movement of a traveling block and tackle and other drilling equipment.

Each of the mast sections 30, 32 and 34 are generally composed of a pair of front mast legs, known as a driller's side front leg 36 and an off driller's side front leg 38. Each of the mast sections also include a pair of rear mast legs, known as a driller's side rear leg and an off driller's side rear leg.

A pair of tubular telescoping hydraulic cylinders 40 and 42 extends between the substructure and the lower mast section 30. The cylinders are used to raise and lower the masts. Hydraulic cylinders are utilized in a preferred embodiment although other types of cylinders might be employed. The hydraulic cylinders 40 and 42 are extended in the in-use, operational position and are retracted in the transport and storage position.

Figure 5:
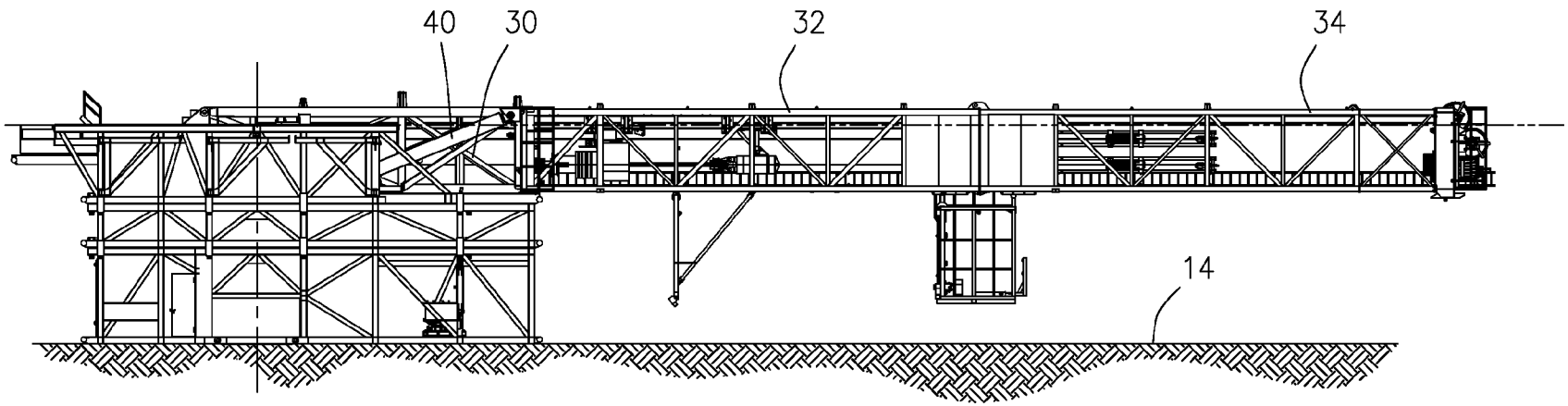
Figure 6:
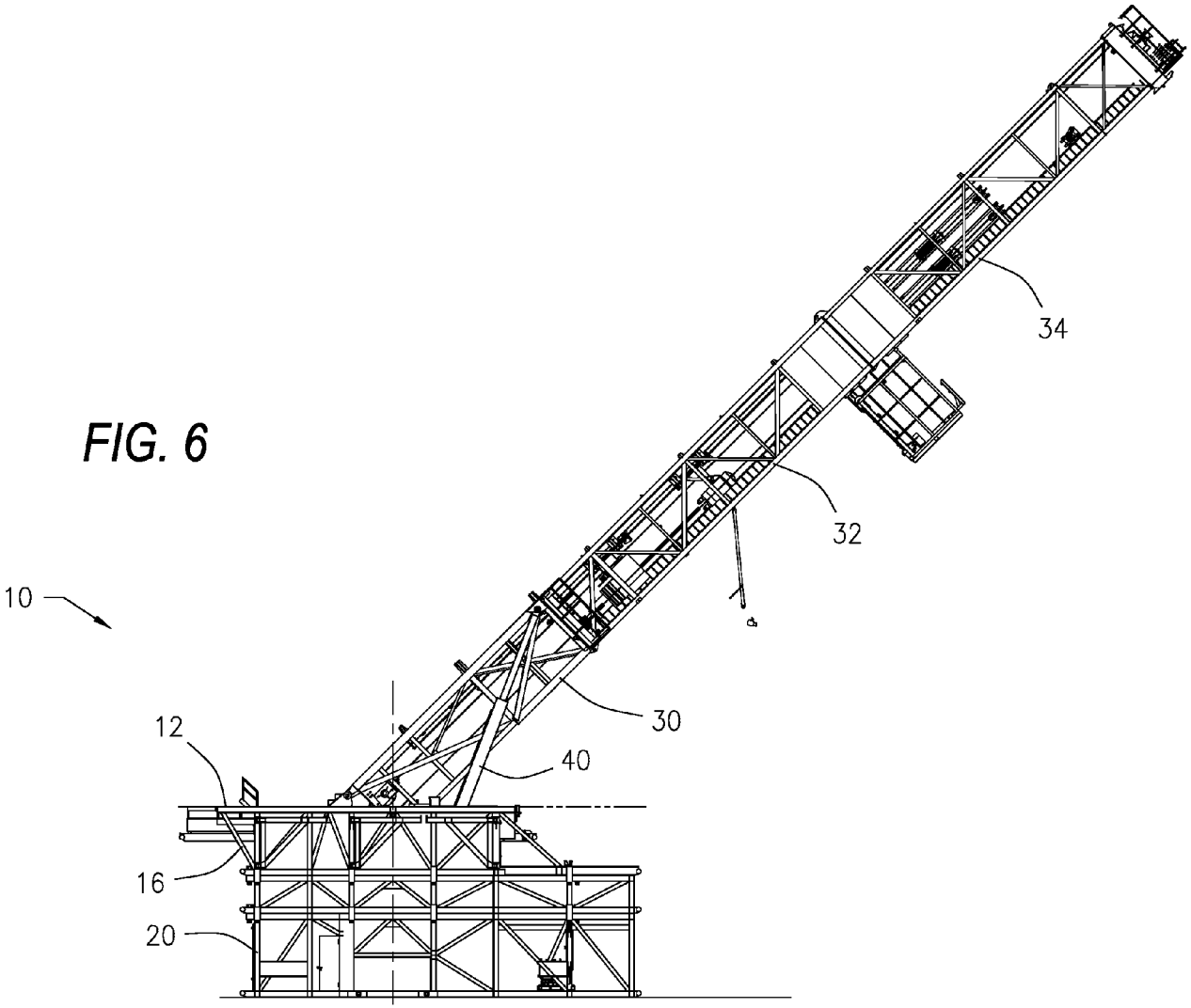
FIG. 6 illustrates a side view of the mast assembly shown in FIG. 1 partially between the vertical operational position in FIGS. 1 through 4 and the horizontal position in FIG. 5.

The lower mast section 30, center mast section 32, and upper mast section 34 move between the vertical upright operational position shown in FIGS. 1 through 4 and the horizontal transport and storage position shown in FIG. 5. FIG. 6 illustrates the mast sections partially moved between the vertical operational position and the horizontal storage position.

Figure 7:
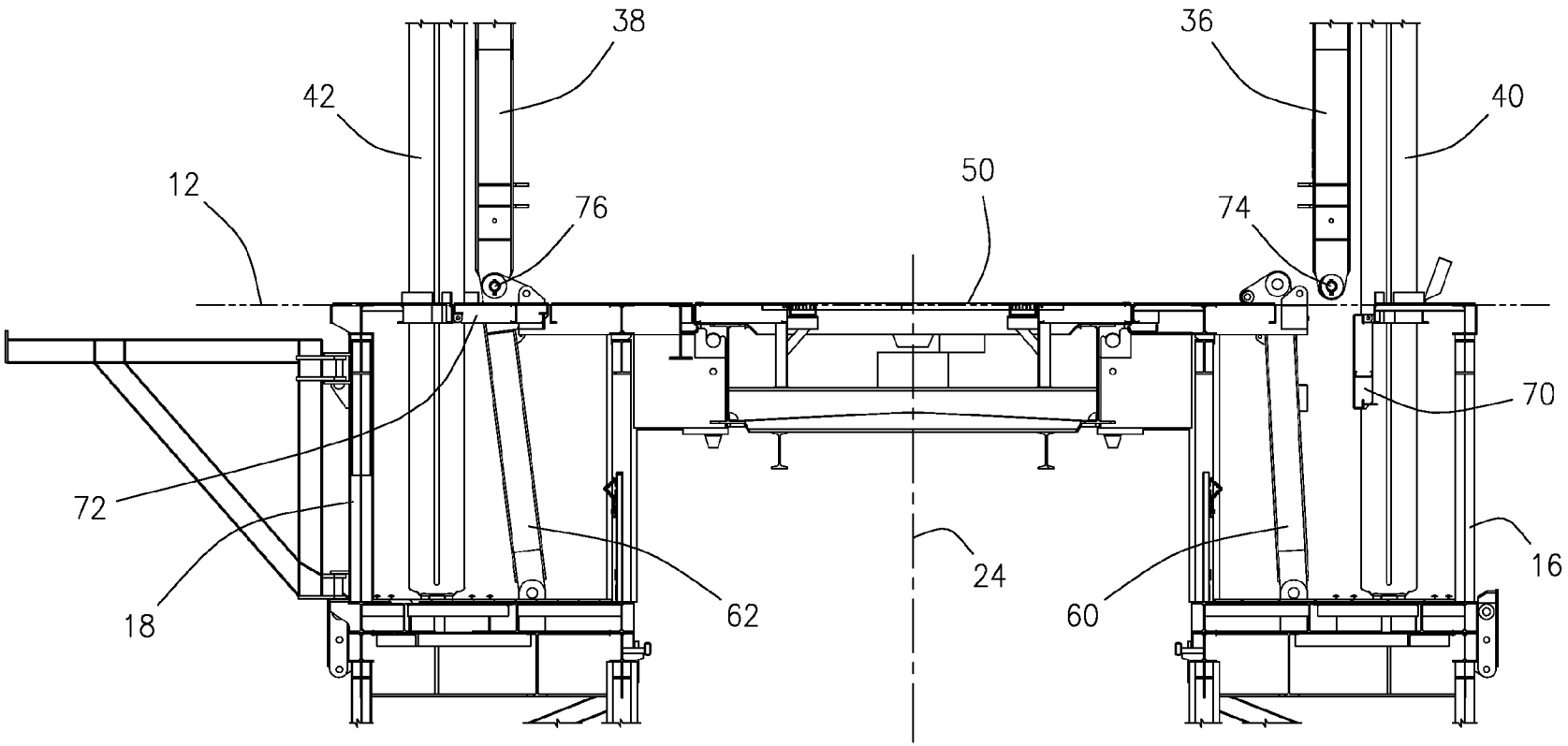
FIG. 7 is a sectional view taken along section line 7-7 of FIG. 2.

FIG. 7 illustrates a sectional view taken along section lines 7-7 of FIG. 2. A center drill floor section 50 extends between the drill floor of first substructure section 16 and the drill floor of the second substructure section 18 over the well center.

A pair of floor sections 70 and 72 is pivotally connected to the drill floor. In the operational position, the floor sections 70 and 72 are parallel and aligned with the drill floor 12 as shown by floor section 72. Prior to moving to the transport position, the floor sections are lowered as shown by floor section 70. As will be described in detail, moving the flooring sections to the lowered position provides space to permit the front leg supports 60 and 62 to move to the transport position and permits lowering of the cylinders 40 and 42 to be nested in the substructures 16 and 18 for storage and transportation.

In order to disassemble the mast assembly after a drilling or servicing operation has been completed, the pair of front mast legs of the lower mast section 30 is disengaged from a pair of front leg supports 60 and 62. Each of the front leg supports 60 and 62 are pivotally connected at one end to the substructure 16 and 18, respectively. The other opposed end of each front leg support 60 and 62 is pinned to the front mast leg 36 and 38. Once the pins or fasteners are removed, the front leg supports may be moved between operational and transport position. Front leg support 62 is shown in the operational position. Front leg support 60 is shown in the transport position.

A pair of front leg pins 74 and 76 secures the front leg supports 60 and 62 to the front mast legs 36 and 38, respectively. Thereafter, the hydraulic cylinders 40 and 42 will be retracted so that the lower mast section, the center mast section, and the upper mast section will rotate about the rear legs to move from the vertical position shown in FIGS. 1 through 4 to the position shown in FIG. 6 and thereafter to the transport position shown in FIG. 5.

Figure 8:
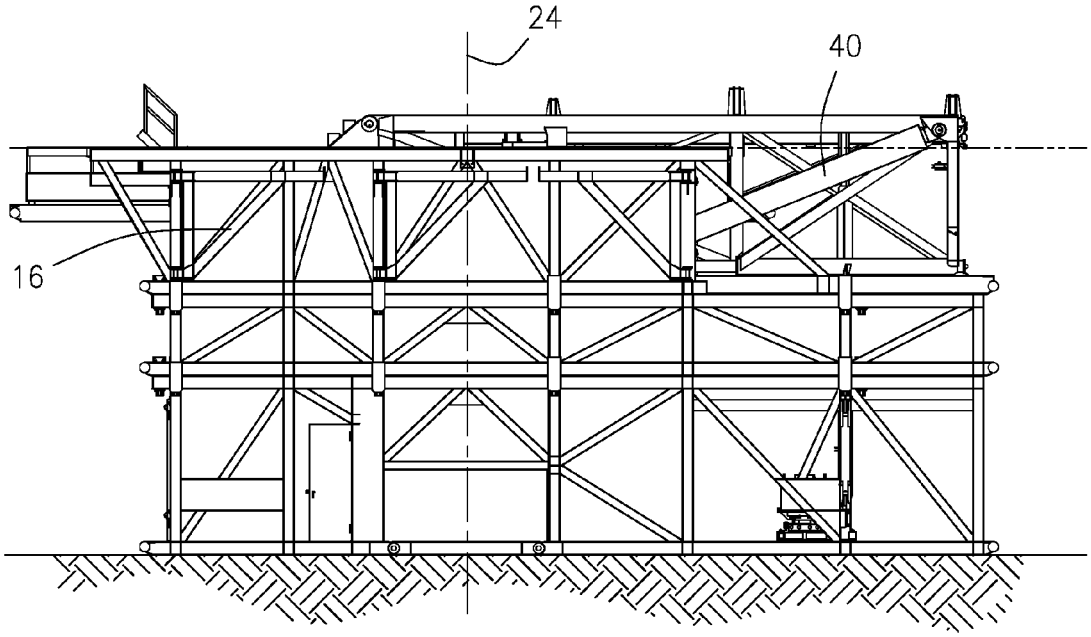
FIG. 8 is a side view.
Figure 9:
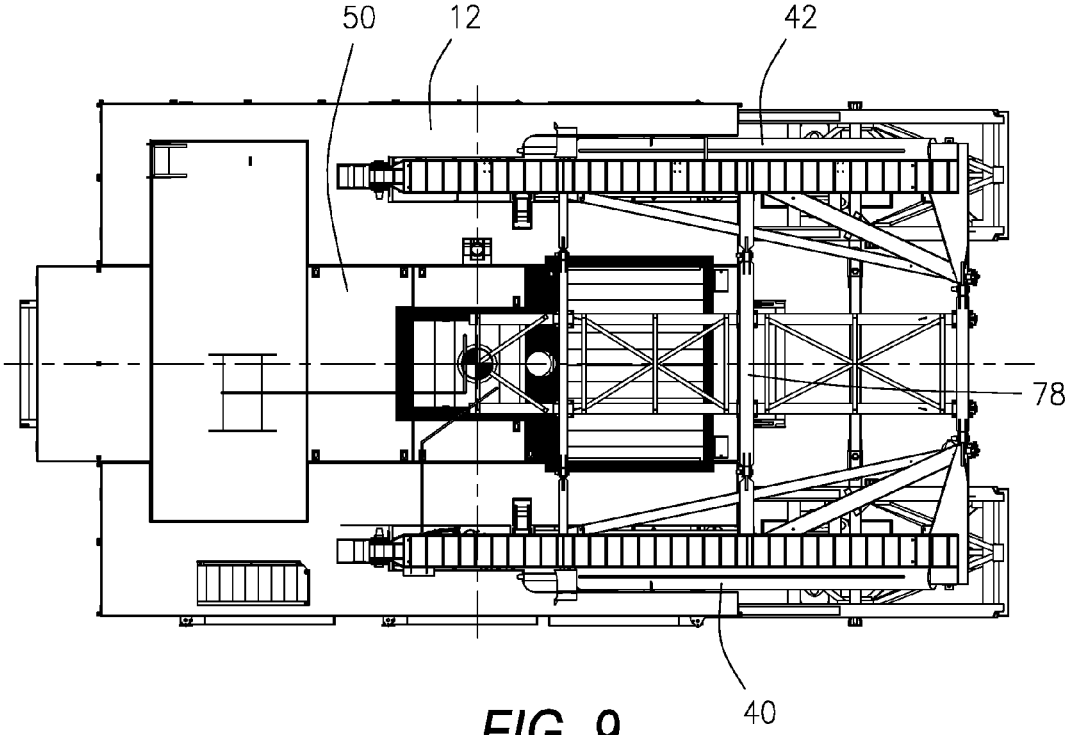
FIG. 9 is a top view of the mast assembly shown in FIG. 5 with an upper mast section and a center mast section removed.

Thereafter, the upper mast section 34 will be disconnected from the center mast section 32 and removed. The center mast section 32 will thereafter be disconnected from the lower mast section 30 in order to be removed and transported. Thereafter, the remaining assembly will appear as shown in the driller's side view in FIG. 8 and the top plan view shown in FIG. 9. The hydraulic cylinders 40 and 42 will be retracted and partially nested within the substructure sections 16 and 18. The rear legs of the lower mast section 30 will likewise be lowered and will be substantially parallel to the substructure sections 16 and 18 and to the drill floor.

Figure 10:
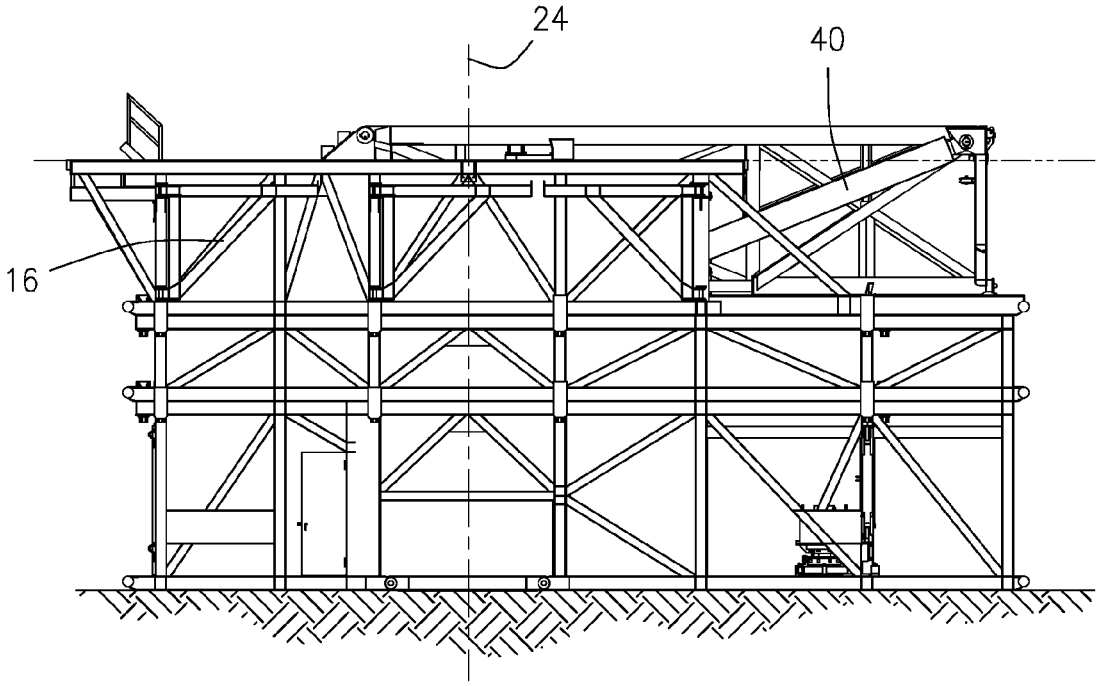
FIG. 10 is a side view and FIG. 11 is a top view of the mast assembly shown in FIG. 5 with a mast center spreader and a center drill floor removed.
Figure 11:
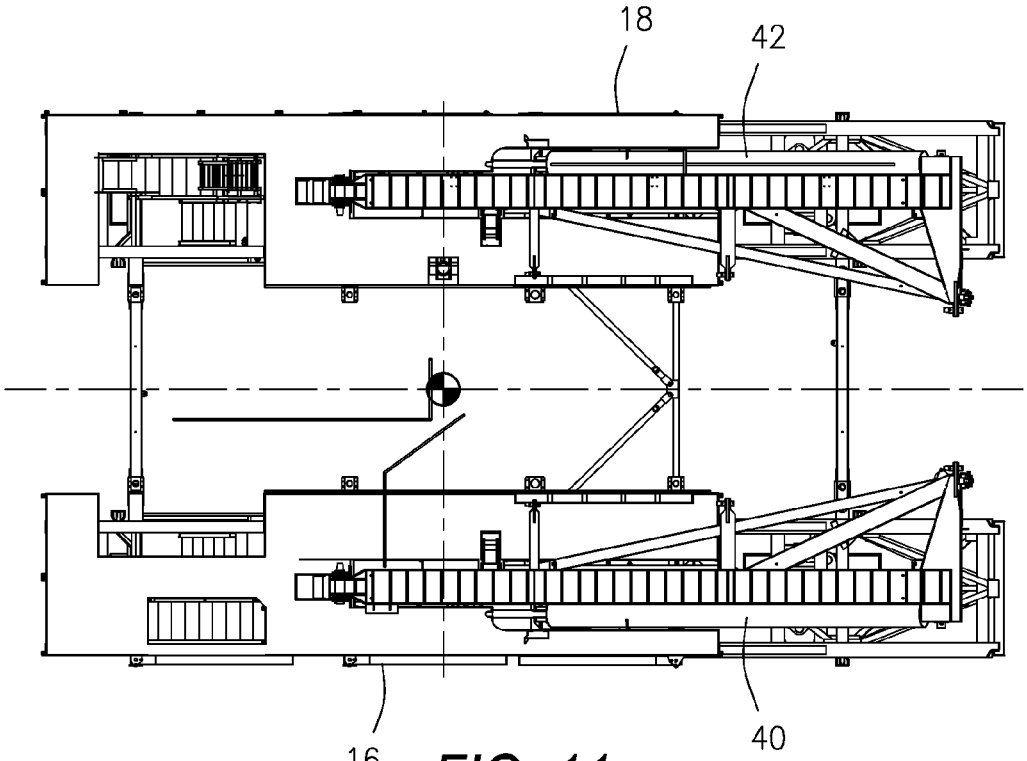

Thereafter, a mast center spreader 78 which extends between the rear legs of the lower mast section 30 will be unpinned or unfastened from the lower mast section and removed as shown in the driller side view in FIG. 10 and the top view in FIG. 11. Additionally, a center drill floor section or rotary set back skid will be removed from the drill floor between the first substructure section 16 and the second substructure section 18. After these steps have been completed, the combination of the first substructure section 16, the first cylinder 40 and a portion of the lower mast section 30 may be readily and easily transported as a unit, such as on a dolly or tractor trailer or trailers. Additionally, the combination of the second substructure section 18, the second cylinder 42 and the remaining portion of the lower mast section may be readily and easily transported, such as on a dolly or a flatbed trailer or trailers.

It will be appreciated from the foregoing that it is never necessary to remove the cylinders that extend between the substructure and lower mast section.

In order to reassemble the drilling rig after transportation to a new location, the opposite procedure is performed.

Initially, a combination of the first substructure section 16, the first cylinder 40 and a portion of the lower mast section 30 are brought into place adjacent the well center. Additionally, a combination of the second substructure section 18, the second cylinder 42 and a portion of the lower mast section 30 are brought into place adjacent to the well center. Thereafter, a center drill floor section 80 is brought into place between the first substructure section 16 and the second substructure section 18 to form a drill floor. A mast center spreader 78 is brought into place and connected between the rear legs of the lower mast section. A center mast section is connected to the lower mast section and an upper mast section is connected to the center mast section.

Thereafter, the lower mast section, the center mast section and the upper mast section are moved from a horizontal storage position to a vertical operational position by extension of the first cylinder and the second cylinder. The rear legs of the lower mast section are pivotally connected to the substructure so that the mast sections rotate.

A pair of front leg supports is pivotally connected to the substructure at one end. The pair of front leg supports are each moved from a transport position to an operational position. The pair of front leg supports is engaged with the pair of front mast legs of the lower mast sections and pinned thereto.

Finally, the pair of floor sections is raised into operational position in line with the drill floor and fastened thereto.

Whereas, the present invention has been described in relation to the drawings attached hereto, it should be understood that other and further modifications, apart from those shown or suggested herein, may be made within the spirit and scope of this invention.

What is claimed is:

1. A method to disassemble a mast assembly having at least a substructure including a first and a second substructure sections, a first cylinder and a second cylinder, and a lower mast section, which method comprises:

disengaging a pair of front mast legs of said lower mast section from a pair of front leg supports;

moving said pair of front leg supports from an operational position to a transport position;

lowering said lower mast section from a vertical position to a horizontal position by retracting said first cylinder and said second cylinder;

removing a mast center spreader from said lower mast section; and removing a center drill floor section from between said first substructure section and said second substructure, for transportation of a combination of said first substructure section, said first cylinder and a portion of said lower mast and a combination of said second substructure section, said second cylinder and a portion of said lower mast.

2. A method to disassemble as set forth in claim 1 including the additional steps of transporting said combination of said first substructure section, said first cylinder and said portion of said lower mast, and transporting said combination of said second substructure section, said second cylinder and said portion of said lower mast on a flatbed trailer or trailers.

3. A method to disassemble as set forth in claim 1 wherein said front mast legs are pinned to said pair of front leg supports and wherein said step of disengaging said pair of front mast legs of said lower mast section includes removing a pair of front leg pins.

4. A method to disassemble as set forth in claim 1 wherein said pair of front leg supports are pivotally connected to said substructure.

5. A method to disassemble as set forth in claim 1 including the additional step of lowering a pair of floor sections on said first and second substructure sections prior to moving said pair of front leg supports from an operational position.

6. A method to disassemble as set forth in claim 5 wherein said pair of floor sections are each pivotally connected to said substructure.

7. A method to disassemble as set forth in claim 1 wherein said mast assembly includes a center mast section connected to said lower mast section and includes an upper mast section connected to said center mast section wherein said upper mast section and said center mast section are removed after lowering said lower mast section.

8. A method to disassemble as set forth in claim 1 wherein said mast assembly includes one or more vertical extensions beneath said pair of substructures.

9. A method to assemble a mast assembly having at least a substructure including a first and a second sections, a first cylinder and a second cylinder, and a lower mast section, which method comprises:

installing a center drill floor section between said first substructure section and said second substructure section;

installing a mast center spreader on said lower mast section;

raising said lower mast section from a horizontal position to a vertical position by extension of said first cylinder and said second cylinder;

moving a pair of front leg supports from a transport position to an operational position; and engaging said pair of front leg supports with a pair of front mast legs of said lower mast section.

10. A method to assemble as set forth in claim 9 including the additional step of raising a pair of floor sections on said first substructure and said second substructure.

11. A method to assemble as set forth in claim 9 wherein said front mast legs are pinned to said front leg supports and wherein said step of engaging said pair of front mast legs includes installing a pair of front leg pins.

12. A method to assemble as set forth in claim 9 including the additional preliminary steps of transporting a combination of said first substructure section, said first cylinder and a portion of said lower mast section, and transporting a combination of said second substructure section, said second cylinder and a portion of said lower mast section.

13. A method to assemble as set forth in claim 9 including transporting said combinations on a flatbed trailer or trailers.

14. A method to assemble as set forth in claim 9 wherein said pair of front leg supports are pivotally connected to said substructure.

15. A method to assemble as set forth in claim 9 wherein said mast assembly includes a center mast section connected to said lower mast section and includes an upper mast section connected to said center mast section.

16. A mast assembly apparatus which comprises:

a lower mast section having a pair of front mast legs;

a substructure including a first substructure section and a second substructure section;

a center drill floor section extending between said first substructure section and said second substructure section;

a first cylinder extending between said lower mast section and said first substructure section and a second cylinder extending between said lower mast section and said second substructure section;

a pair of front leg supports pivotally connected at one end to said first and second substructure sections and removably connected at an opposite end to said pair of front mast legs, wherein said pair of front leg supports are in an operational position connected to said pair of front mast legs; and wherein a storage and transportation positions are disconnected from said pair of front mast legs.

17. A mast assembly apparatus as set forth in claim 16 including a center mast section connected to said lower mast section and an upper mast section connected to said center mast section.

18. A mast assembly apparatus as set forth in claim 16 including a mast center spreader extending between a pair of rear legs on said lower mast section.

19. A mast assembly apparatus as set forth in claim 16 including a pair of floor sections pivotally connected to said substructure.

* * * * *